United States Patent [19]

Nicoulaud et al.

[11] 4,235,387

[45] Nov. 25, 1980

[54] WINDING APPARATUS, ESPECIALLY FOR STRANDS FORMED OF THERMOPLASTIC MATERIAL

[75] Inventors: Jean R. Nicoulaud, Challe-les-Eaux; Georges Fromaget, La Motte Servolex, both of France

[73] Assignee: Saint-Gobain Industries, Neuilly-sur-Seine, France

[21] Appl. No.: 927,606

[22] Filed: Jul. 24, 1978

[30] Foreign Application Priority Data

Aug. 3, 1977 [FR] France ..... 77 23947

[51] Int. Cl.[3] ..... B65H 54/08; B65H 54/28

[52] U.S. Cl. ..... 242/18 G

[58] Field of Search ..... 242/18 G, 18 R, 43 R

[56] References Cited

U.S. PATENT DOCUMENTS

| | | | |
|---|---|---|---|
| 2,463,773 | 3/1949 | Jencks | 242/18 R |
| 2,972,450 | 2/1961 | Brierley | 242/18 R |
| 3,367,587 | 2/1968 | Klink et al. | 242/18 G |
| 3,547,361 | 12/1970 | Klink | 242/18 G |
| 3,617,009 | 11/1971 | Lawson et al. | 242/18 R |
| 3,717,311 | 2/1973 | Smith | 242/18 R |
| 3,801,032 | 4/1974 | Sears et al. | 242/18 R |
| 3,819,122 | 6/1974 | Genson | 242/18 R |
| 3,838,827 | 10/1974 | Klink et al. | 242/18 G |
| 3,845,912 | 11/1974 | Eichmanns et al. | 242/18 G X |
| 3,897,021 | 7/1975 | Shape | 242/18 G |

*Primary Examiner*—Stanley N. Gilreath
*Attorney, Agent, or Firm*—Charles H. Lindrooth

[57] ABSTRACT

This winding-apparatus comprises a spindle or collet on which strand or roving is wound and an oscillating mechanism carrying a traverse guide and a follower. The follower is in contact with the circumference and activates an excitation element which continuously acts on a hydraulic or an electric motor which operates the oscillating apparatus. In this way, the oscillating apparatus moves progressively away and by a continuous motion from the spindle as the spool grows. The follower 14 is balanced around an oscillation axis Z-Z to exert a minimal force on the spool. The application disclosed is the winding of strand formed of glass filaments coming from a bushing.

10 Claims, 6 Drawing Figures

WINDING APPARATUS, ESPECIALLY FOR STRANDS FORMED OF THERMOPLASTIC MATERIAL

FIELD OF INVENTION

The present invention is generally concerned with the technique of winding rovings or strands, and is more particularly related to winding-machines intended for winding strands made from thermoplastic material such as glass filaments drawn from a bushing.

BACKGROUND AND THE PRIOR ART

It is knwon that when spools of strand, especially glass strand are wound, it is essential that the outside surface of the spool be as homogeneous as possible and in particular, that the wound strand does not go beyond, even slightly, the ends of the spool, in order to avoid damage to the strand during later handling.

In order to make cylindrical spools, winding-machines have already been devised which include a forked thread to strand-guide which receives the strand to be wound from means such as bushing. The strand-guide is situated as near as possible to the winding spools, parallel to the axis of the spindle on which the spool is formed. The extent of the oscillatory motion corresponds approximately to the height of the spool to be formed, that is to say, to the length of its generator.

During spool formation, spool diameter increases progressively and it is therefore necessary to withdraw the thread-guide, and the unit on which it is movably mounted, away from the spindle for the strand in order to keep the same relative possition of the strand guide and the outer surface of the developing spool.

Winding-machines of this type have already been described in the following patents: U.S. Pat. Nos.: 3,367,587; 3,371,877; 3,498,550; 3,547,361; 3,717,311; 3,897,021; 3,801,032; 3,819,122; 3,838,827 and 3,845,912.

Among these patents, the most representative of the prior art is U.S. Pat. No. 3,547,361 in which a winding-machine is disclosed including a fixed frame on which a spindle or collet is rotatably mounted on which the strand is wound. This spindle or collet is connected to rotation means which also act on a strand-guide assembly to reciprocate the strand-guide, with the whole assembly being mounted for oscillation on the frame. The winding-machine also includes a driving means intended to cause rotation of the whole strand-guide in relation to the spindle, in accordance with the increase of the spool diameter during development. This drive means includes a regulating loop comprising a feeler for detecting the spool growth, and a drive means intended to rotate the arm and having an exciting unit responsive to the feeler position.

The feeler is preferably a roller which comes into contact with the spool when the strand-guide is placed immediately above the roller. The strand passes through the strand-guide then under the roller, after which it is wound on the spool.

The roller is fixed on an oscillating arm and is brought back towards the spool by a yieldable device formed of several pneumatic jacks. The oscillating arm can withdraw under the effect of the increase in spool size by means of an electric contact or a close-up detector which forms the excitation element and which acts when closed on the motor to move the oscillating arm away.

The disadvantage of the winding apparatus disclosed in U.S. Pat. No. 3,547,361 is especially the intermittent withdrawal motion of the oscillating arm in view of which the arm can move only by increments which cannot, from a practical point of view, be as small as desired.

The effect of incremental motion of the oscillating arm, which reflects itself on the thread-guide as well, is to produce periodically variable winding conditions. Depending on the case, the result is that the distance between the thread-guide and the spool cannot be as uniform as desired ad especially that the follower cannot exert a constant pressure on the spool or package.

While this effect may initially seem insignificant, in practice especially where glass strands are wound, the applicants have observed that the spools obtained show various defects because of the following imperfections.

The distance between the thread-guide and the roller follower is a factor which conditions the precision of the spool height (its generator length). If the precise accuracy is not rigorously the same the sides of the spool are irregular and concentric rings and corrugations can be observed which are composed of windings of thread more or less coming out of the body of the spool. A possibility of wear of these corrugations exists where ulterior manipulations occur in these particular places.

If the roller follower exerts an irregular pressure on the spool, the degradation of the strand follows these pressure changes. It results that the quality of the wound strand is not constant.

The lack of fidelity commonly recognized in making electric contact by the excitation element can produce irregular and relatively large increments of motion of the oscillating arm, that give slight variations on the spool in the wound length and irregularity in the spool sides as well. If the excitation element is formed by an electric microswitch contact, the follower must, in addition, overcome the resistance of this contact. This disturbs the application effort of the idler on the strand of the spool, which accentuates again its deterioration. The discontinuous efforts and the motion have the consequence that the resulting spool does not have a regular quality since at some time, the strand is exposed to a very low pressure.

In order that the roller follower is able to operate the excitation element formed by the electric micro-switch, it is necessary, since this roller follower belongs to equipment mounted for oscillation on the arm which itself is oscillating and which carries the thread-guide ad the micro-switch, that the spool surface exert a relatively large force on the follower on the order of 4 to 5 newtons, for example, in the case of the apparatus shown in U.S. Pat. No. 3,547,361.

To reduce this force, the equipment shown in this patent is provided with a system of jacks mounted between the mobile equipment of the follower and the oscillating arm. However, this system is relatively complicated and in any case very difficult to maintain because of the friction caused by the internal rubbing of the jacks.

SUMMARY AND OBJECTS

The object of this invention is to provide a winding-machine of the above type, but without the described disadvantages.

The invention is a winding-machine as for strands of thermoplastic materials such as glass rovings or strands formed from filaments drawn from a bushing, characterized in that the excitation element is a continuous control element. Because of this characteristic, it becomes possible to form a control loop for th withdrawal command of the thread-guide which does not include the variable operation of the above described technique. With a minimal effort, a relatively large effect is exerted by the spool on the follower; the shifting occurs by the simple increase of the spool diameter during development. In this way, the whole oscillating arm and all the elements it carries move away from the axis of the collet carrying the spool during its formation by a rigorously continuous motion which is directly related to the increase in spool diameter. The displacement signal produced by the follower roller is processed in the control loop and transformed into the force necessary to move the whole oscillating arm away from the spindle axis.

According to another important aspect of the invention the body formed by the follower roller and its support is balanced by simple gravity and is associated with a simple device permitting the careful regulation of the pressure exerted by the follower roller on the outer surface of the spool.

Because of this characteristic, the pressure exerted by the follower roller on the spool can be notably reduced, which practically avoids any damage to the thread. Moreover, it is possible to increase the inertia of the oscillating assembly caused by the follower, so as to avoid bouncing and to unify the input signal of the control loop. Therefore, the shifting of the oscillating arm can be as uniform as possible, which contributes to a rigorous evenness of the spool ends.

Other objects, advantages and characteristics of the invention will appear in the course of the following description.

BRIEF DESCRIPTION OF THE DRAWINGS

Concerning the attached drawings, given only as examples.

DESCRIPTION OF PREFERRED EMBODIMENTS

Figure 1:
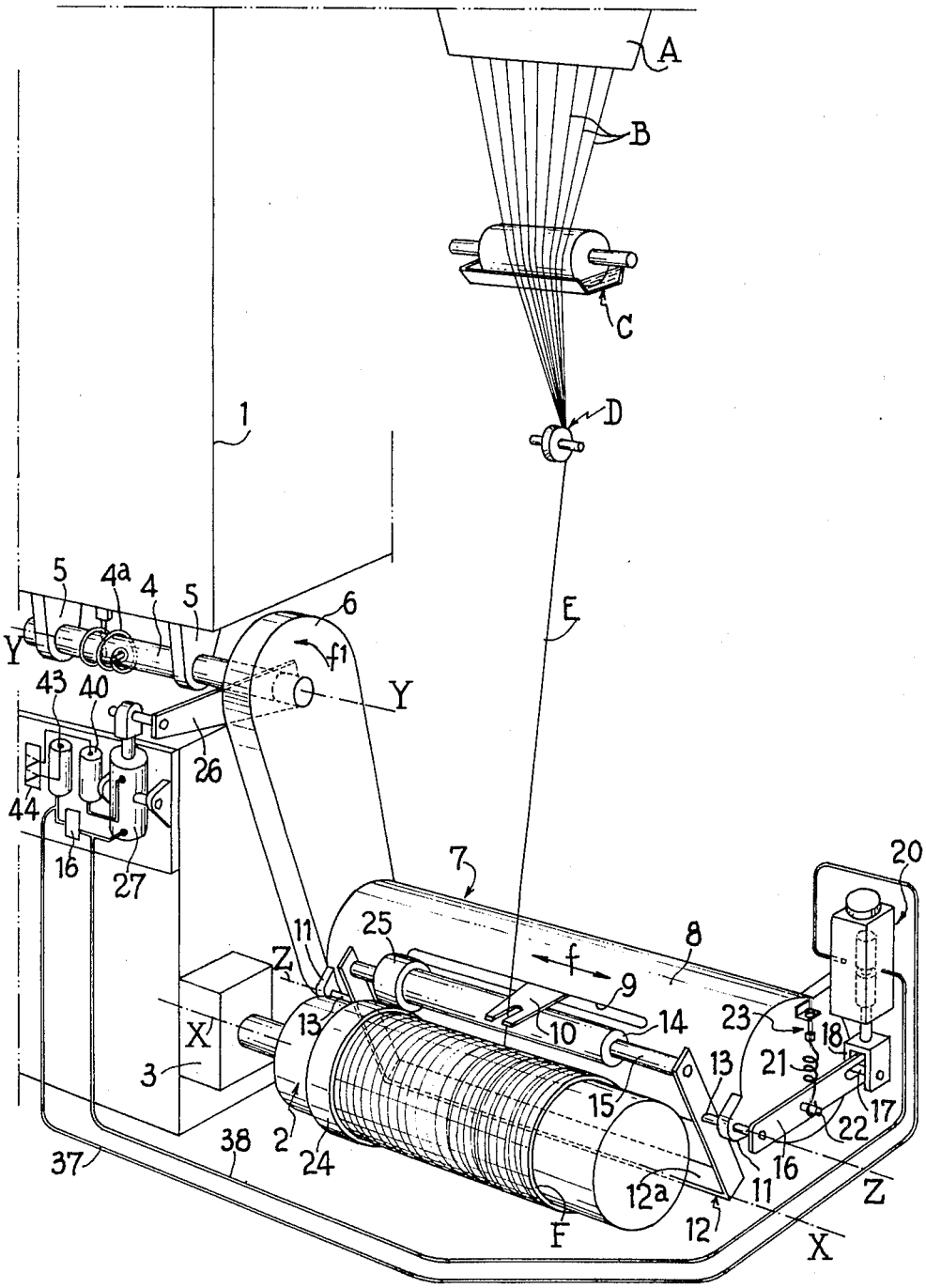
FIG. 1 is a schematic view in perspective of winding-apparatus made according to the invention.

According to the embodiment of the invention represented in FIG. 1, the winding-apparatus is connected to a bushing A, which continuously produces a number of filaments B, which are coated by means of device C, and gathered by a small wheel D, the resulting strand E being led towards the winding apparatus.

The winding-apparatus comprises a frame 1, in which a collet or spindle 2 is rotably mounted on axis X—X. Sleeves F are intended to be placed on the spindle or collet to form the core of the spool to be formed. Collet 2 is rotated by drive means, a part of which can be seen at 3.

A shaft 4 is mounted for rotation about axis Y-Y which is parallel to axis X—X. This shaft is journalled in bearings 5 fixed on the frame, and restrained by a torsion spring 4*a*. An oscillatable arm is mounted on one end of the shaft 4. The lower end of arm 6 carries a strand traverse guide assembly 7. This assembly is located within a housing 8 in which a horizontal slot 9 is cut and through which is extended a traverse-guide 10 shaped as a fork. The strand E goes through the traverse-guide 10, before being wound on the sleeve F mounted on spindle 2. As is known, the traverse-guide 10 moves in a reciprocating motion as shown by arrow F by means of a mechanism comprising a barrel cam with crossed spiral grooves, the traverse-guide 10 being thus continuously moved in alternating motion parallel to the X—X axis of spindle 42.

The drive means of the traverse-guide being well known, it detailed description is unnecessary for an understanding of the invention.

The housing 8 also carries two bearing members 11 disposed respectively on each of its extremities as represented schematically in FIG. 1 and in greater detail in FIG. 4, which will be discussed later.

Figure 2:
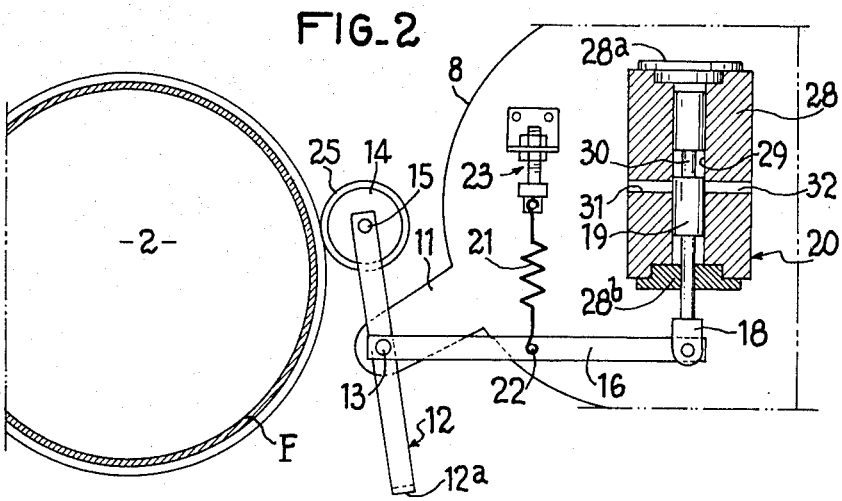
FIGS. 2 and 3 are partial views in section presenting the outline of some parts of the winding-apparatus respectively at the start of the spooling operation and at a certain time thereafter.
Figure 3:
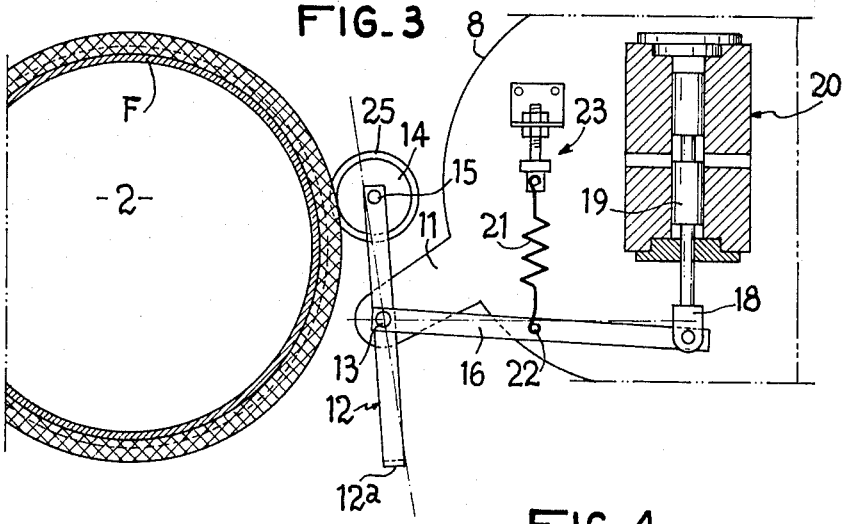

An oscillating support bail 12 is mounted for oscillation by means of spindles 13 which extend outwardly from the side wings of the bails and are journalled in the bearing members 11. A roller follower 14 is mounted for free rotation on a shaft 15, which is in turn carried by the free ends of the side wings. The spindle 13 which is located near the free end of housing 8 extends beyond the bearing member 11. A lever 16 is fixed to the free end of one spindle 13 so that it exactly follows the oscillating motion of the oscillating support bail 12. The end of lever 16 opposite to spindle 13 is forked and this forked end fits over a pin 17 carried by forked piece 18. This forked piece is fixed on the projecting end of a rod which depends from spool 19 of a regulation valve 20 as is best shown in FIGS. 2 and 3 and which forms the excitation or control element of the command loop of the winding-machine.

A tension spring 21 is attached at one end to a pin 22 on the lever 16 and on the other end to an adjustable tension device 23 mounted on the end of housing 8. The spring urges the lever 16 and the support 12 in a way which brings the follower 14 towards the rotational axis (X—X) of spindle 2. FIGS. 1 to 3 show, in addition, that spindle 2 is provided with a small peripheral collar 24 which is intended to cooperate with a small collar 25 formed as for example of elastomer and mounted on the roller follower 14. As shall be seen, the contact setting of these small collars 24 and 25 is intended to make the starting of roller 14 easier. The respective diameters of these small collars 24 and 25 are calculated to obtain, at the start of winding, a speed of the roller-follower which is equal to, or preferably slightly less than, the peripheral speed of sleeve F.

It is to be noted that the whole support 12 and the roller follower 14 is balanced around axis Z—Z, which can easily be done by adjusting the mass of the horizontal portion 12*a* of support 12 with respect to the mass of the roller follower 14.

The regulation device 23 of spring 21 is intended to adjust the pressure with which the roller follower 14 bears on the spool during the course of package formation.

A lever 26 rotatably associated with the oscillating arm 6 is connected at its free extremity to the shank of a jack 27 which forms the motor device of the control loop of the winding-machine. The jack 27 is mounted for oscillation on a small mounting plate rigidly mounted in the frame 8 and which also carried various command devices represented in detail on FIG. 5. In FIG. 1, it can be seen that the shank of jack 27 is connected to the oscillating arm 6 so that the arm is caused to rock around axis Y—Y in the direction of arrow f1 to cause movement of the equipment it carries away from the axis X—X of the spindle 2 of the winding apparatus.

The valve shown particularly in FIGS. 2 and 3 comprises a valve body 28, for example, in which a bore 29 having a very restricted tolerance (of about 3 microns for example) is formed. The slide 19 is preferably formed of steel. It is to be noted, that the valve comprises a means to avoid any resistive effort which could influence the motion of the body comprised of support 12, the roller follower 14 and the lever 16.

The slide 19 comprises at its center a reduced diameter portion 30 which permits communication between passages 31 and 32 in the body 28 perpendicularly to the axis of the bore 29. The bore 29 is closed at its end by plugs 28*a* and 28*b*, the lower plug 28*b* having an opening for the shank of slide 19.

Figure 4:
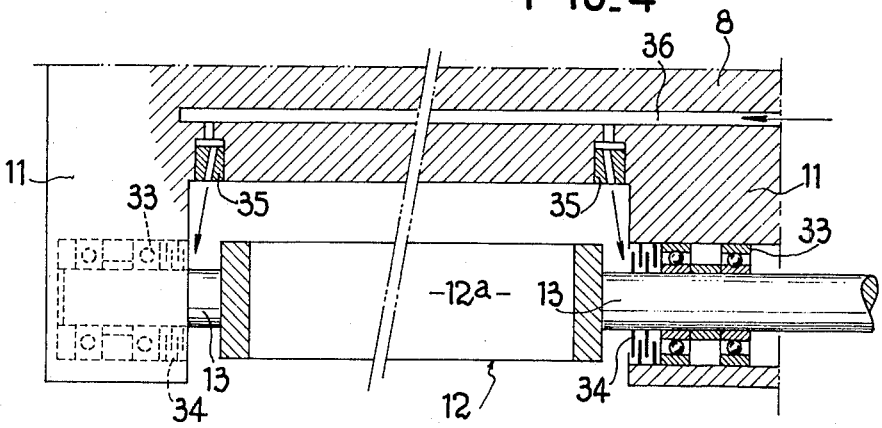
FIG. 4 shows a view in section, on an enlarged scale, of the suspension means for the follower roller.

From FIG. 4, it can be seen that the shafts 13 of the oscillating supports 12 are mounted in bearing means such as ballbearings 33, mounted in the supports 11, the bearings being intended to ensure a perfectly free oscillation of stirrup or bail 12, without any play. The bearings 33 are preferably protected by baffles 34, to protect them from dust and other dirt arising from the winding operation.

To avoid sealing or sticking of the bearings 33, and of the baffles 34, nozzles 35 mounted in the housing 8, are provided on each side of the stirrup or bail 12, and connected to a water circuit 36 which delivers water under pressure. In this way it is possible to constantly spray water under pressure on the protective baffles. The sprayed water is preferably softened to avoid the scaling of the nozzle noses 35. In addition, all the parts including the bearings are preferably formed of stainless steel.

Figure 5:
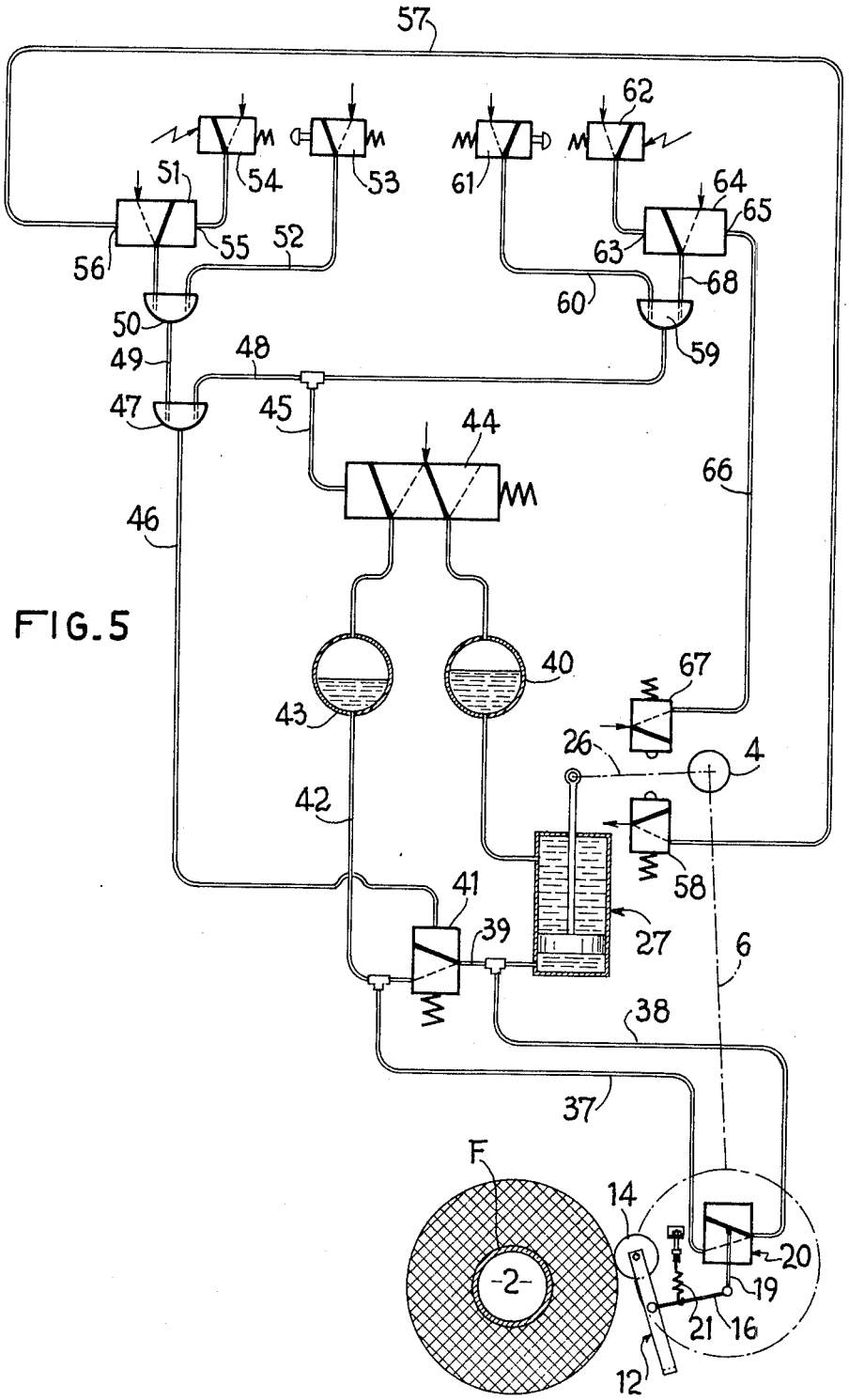
FIG. 5 is a simplified schematic of the winding-apparatus command assembly comprising the control loop, according to a first embodiment of the invention.

As can be seen from reference to FIGS. 1, 2, and 5, the valve 20 is connected through its ports 31 and 32 and through its respective conduits 37 and 38 to a hydraulic circuit in which driving means for moving the arm 6, comprising jack 27 is mounted.

Jack 27 is connected on the side of the free or lower face of its piston, as viewed in FIG. 5, to a passage 39, and on the opposite side of its piston to an air-oil exchanger 40. The passage 39 is connected to the input of an oil-air valve 41, the exit of which is connected to the conduit 37, and by a conduit 42, to a second air-oil exchanger 43.

The air inlets of the exchangers 40 and 43 are connected to a distributor 44, with five ports and with pneumatic command allowing the exchangers 40 and 43 to be connected either with a source of pneumatic pressure or with the atmosphere under the control of the pressure existing in passage 45.

The oil-air valve 41, is connected by a passage 46 to the output of a pneumatic logic gate 47, of OR function, having a first input which is connected to the passage 45, the passage 48. The other input is connected by passage 49 to another logic OR gate 50 having a first input passage which is connected to a memory element 51, and a second input which is connected by a passage 52 to a manually controlled valve 53, with manual control which is intended to cause the withdrawal of the mobile equipment formed by arm 6 and the housing 8, from the axis X—X of spindle 2. The memory element 51 is connected to an electrically operated valve 54, for automatic control of the withdrawal motion, this valve being connected to the command input 55 of memory element 51. The other input 56 of element 51 is connected by a passage 57 to a valve 58. Valve 58 is located at the end of the withdrawal path and is activated in order to put passage 57 under pressure when the piston of the jack 27 is in its lower extreme position.

The passage 48 is also connected to the output of a pneumatic OR gate 59 whose the first input is connected by passage 60 to valve 61 for a manual command which starts the motion of bringing the mobile equipment towards the X—X axis of collet or spindle 2. Valve 62 provides automatic control of this same motion. For this purpose valve 62 is connected to a command input 63 of memory element 64 whose other command input 65 is connected by passage 66 to a detection valve 67 which is located at the other end of the path of movement of the mobile apparatus 6,8. The valve 67 is therefore actated when the piston of jack 27 reaches its extreme upper position to put passage 66 under pressure. The output of the memory element 64 is connected to the other input of the OR gate 59 by passage 68. The winding apparatus operates as follows:

To prepare spindle 2, the housing 8, containing the mechanism for reciprocating motion of the traverse guide 10, has to be moved away as much as possible. For that purpose, the operator actuates valve 53 to cause manual withdrawal control motion.

Before beginning the winding, guide 10 must be brought back very close to the spindle 2. This operation is made automatically when the winder starts running by means of valve 62.

When the winding is ended, the traverse guide 10 has to be moved away. This operation can be made automatically or manually by means of valves 53 and 54.

To move traverse guide 10 and the housing in which it is mounted closer to the spindle 2 the shank of jack 27 has to move upwards. Consequently, the exchanger 40 must be vented to atmosphere and the exchanger 43 must be put under pressure. The distributor 44 must therefore be activated as well as the oil-air valve 41 which is placed in parallel with valve 20 of the control loop; a rapid closing-in motion can thus be obtained.

When the winding operation begins, the roller follower 14 is not yet in contact with the sleeve F which has been placed on the spindle 2 (see FIG. 2) but because the spindle 2 is rotatably driven by drive means 3, the small collar 24 of this spindle causes rotation of the small collar 25 of the roller follower 14.

When the thickness wound on the sleeve F reaches a thickness of 1 to 2 mm, that is to say greater than the total thickness of the small collars 24 and 25, the surface of the spool in course of development comes into contact with the roller follower 14. By continuous enlargement the spool then moves the roller 14 away which is always in contact with it because of the effect of the traction spring 21, which exerts a predetermined force of a few newtons.

In the course of its shifting, which can be on the order of 1 to 1.5 mm, for instance, roller 14 causes the oscillating support 12 to swing around shaft 13 which in turn causes rocking of the lever 16 which is joined to one of these shafts.

The result is that lever 16 draws the slide 19 of the valve 20 towards the bottom of the valve chamber so that the openings 31 and 32 of this valve 20 are placed in communication.

The oil under pressure contained in the exchanger 40, then causes the shank of jack 27 to retract because the oil of the jack beneath the piston flows out through passage 38, through the valve 20, the passages 37 and 42, to the exchanger 43, this latter being vented to the atmosphere.

This has the consequence of making the housing 8 and oscillation arm 6 swing and the housing 8 continuously move the thread-guide 10 and its reciprocating mechanism away from the spool in course of its development.

When the valve 20 begins to open, the withdrawal motion described above is at a lower speed than the rate of increase of the spool in the radial direction. Under these conditions, the roller follower 14 continues to be pushed away by the spool, which causes an increase in the size of the passage between the openings 31 and 32 of valve 20. The withdrawal speed of the apparatus 6, 8 and 10 then increases until it reaches the rate of radial increase of the size of the spool. When the speeds are equal, the system maintains a stable opening through valve 20.

The diameter of openings 31 and 32 of valve 20 is calculated to allow enough oil delivery at full opening to follow the intended fastest radial speed increase, in other words about 0.2 mm per second for instance.

When the winding goes on increasing, the rate of increase of the spool in the radial direction decreases. The roller follower 14 moves back little by little towards its initial relative position under the effect of traction spring 21, which consequently moves the spool 19 back in valve 20 and partially closes openings 31 and 32, thereby permanently assuring an equality in the drawing-away speed of the roller follower and the increase of speed of the spool in the radial direction.

When the winding is completed, the movable apparatus 6, 8, and 10 is moved away from the axis X—X of spindle 2 thanks to the automatic feeding of the electrically operated valve 54 which causes the opening of the oil-air valve 41 mounted in parallel to valve 20.

When the roller follower 14 is not longer in contact with the spool, it returns to its initial position under the effect of spring 21, which closes valve 20.

The various operating devices 53, 54, 61 and 62 act on the winding machine in the following manner:

Manual withdrawal: Actuation of the manually operated valve 53 sends air through the OR gates 50 and 47 on the oil-air valve 41, which opens the valve to make the jack shank 27 retract and thus cause the withdrawal.

Automatic withdrawal: An electrical impulse applied to electrovalve 54 delivers air under pressure to input 55 of the memory element 51 in order to open it. The memory element 51 holds the open position, and sends air through gates 50 and 47 on valve 41, which has the same effect as before. When the withdrawal motion is ended, the jack 27 actuates the end of course valve 58 which by means of passage 57, puts the control input 56 of the memory element 51 under pressure, which returns this element to its initial closed state. It follows that the valve 41 closes.

Manual closeness: The manual operation of valve 61 sends air under pressure through OR gate 59 to the control input of distributor 44 via passage 45. Air under pressure is also sent to valve 41 as well through OR gates 59 and 47 through passages 48 and 46. The distributor 44 is therefore switched in consequence of which air under pressure is applied to exchanger 43, while exchanger 40 is vented to the atmosphere. It follows that the shank of jack 27 moves out of its cylinder.

Automatic closeness: An electrical impulse applied to electro-valve 62 sends air under pressure to the input 63 of memory element 64 which opens and stays in this position, sending air under pressure through gates 59 and 47 and conduits 48 and 46 to valve 41 and also by gate 59 and conduits 48 and 45 to distributor 44.

When the movement towards the spool is at an end, jack 27 actuates end-of-course valve 67 which resets the memory element 64 to its initial state through conduit 66. Resetting of this memory element allows distributor 44 and valve 41 to return together to their closed positions.

The control device which has just been described by referring to FIG. 5 can be replaced, according to another embodiment of the invention by a control device of electronic type.

In that case, (FIG. 6) the excitation element of the control loop of the winding machine comprises a displacement detector 70 whose electrical output signal is in proportion to the displacement of a plunger cell 87, which is connected to the lever 16 as in the preceeding embodiment in the place of the spool 19 of valve 20. This displacement detector can be realized with advantage in the form of a differential transformer type detector made for example by the firms SCHAEVITZ or NOVOTECHNIK (West-Germany). These detection instruments have the advantage of requiring very little driving effort, so that they are very well suited to the application considered here.

Figure 6:
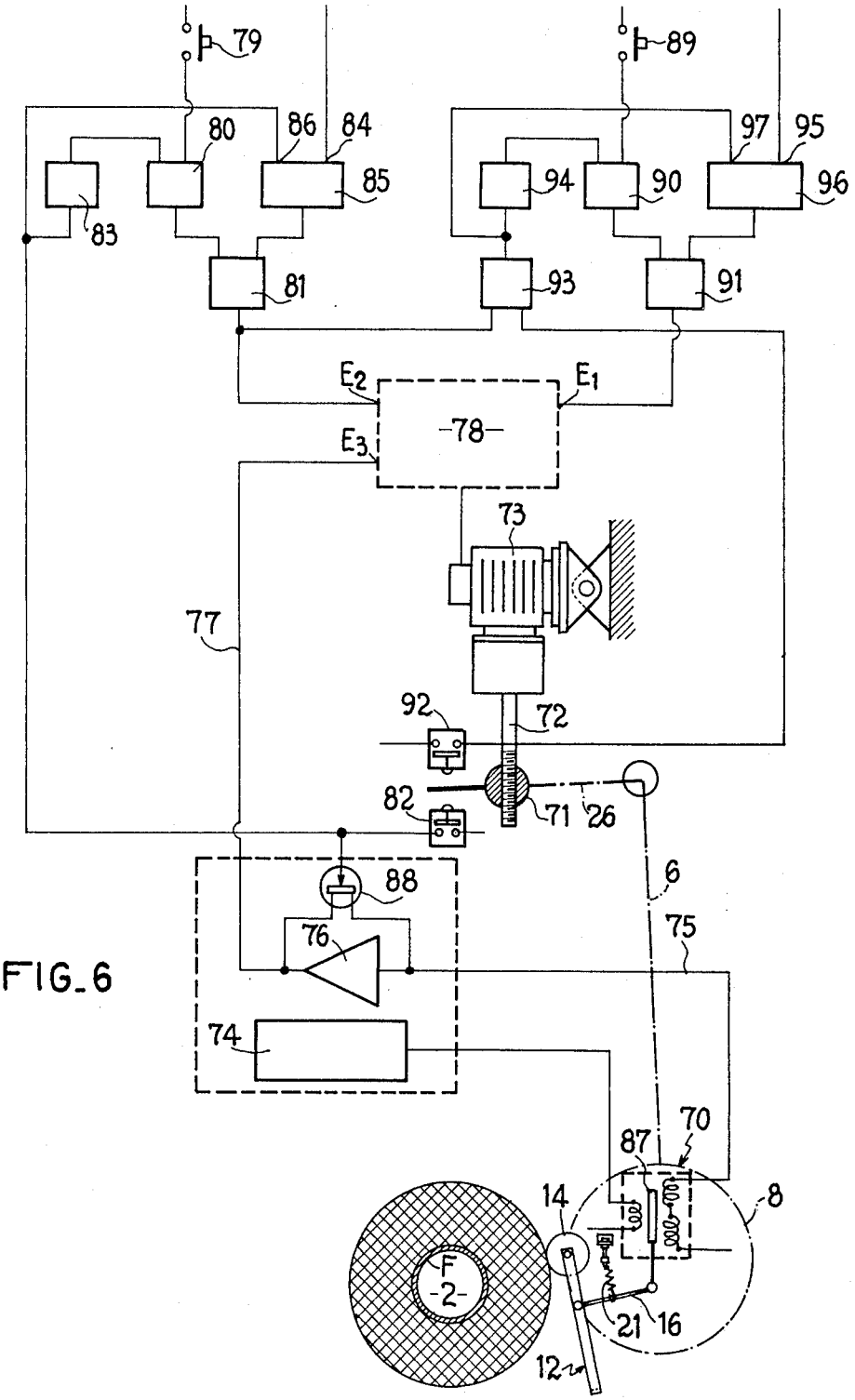
FIG. 6 is a schematic analogous to that of FIG. 5 representing a second embodiment of the invention.

In the case of FIG. 6, the oscillating arm 6 is coupled by lever 26 to a nut 71 of a mechanism with screw 72 coupled to an electric motor device 73 fixed on the frame of the winding-machine.

The displacement detector 70 is mounted on the housing 8 in the same way as valve 20 of the embodiment of FIGS. 1 to 5. It is connected to an electrical power supply circuit 74 which is usually furnished by the manufacturer with the displacement detector 70. The displacement detector 70 produces a signal on line 75 which is connected to the input of an amplifier 76. The output of the amplifier is connected through line 77 to a power supply 78 of the electric motor device 73. Its power supply can be of a D.C. type and is of variable speed and being able to turn the motor in both directions for example between 0 and 3000 revolutions per minute. The power supply 78 preferably comprises an electronic speed variator. All these elements being well known a detailed description is not given. They can be obtained commercially for instance from the company Nervus.

The power supply 78 has three inputs E1, E2 and E3, which have the following functions.

Input E1: On-off control with maximal speed of the motor 73 for the drawing-closer motion of arm 6;

Input E2: On-off control with maximal speed of motor for the withdrawal motion of this arm;

Input E3: Control which is proportional to the signal of detector 70 giving proportional and variable withdrawal speed of the arm 6.

The elements of the control apparatus just described are connected with several logical components which are intended to accomplish the same control actions as those described in connection with the embodiment of FIG. 5. These actions are briefly reviewed with reference to FIG. 6:

MANUAL WITHDRAWAL OF ARM 6

Pressure on manually controlled button 79 sends a signal to the input E2 of block 78 through an AND gate 80 and OR gate 81.

When the withdrawal motion is ended, the lever 26 activates an "End of Course" contact 82 which cancels the signal given by the control button 79 through an inverter circuit 83 by obstructing the output signal of AND gate 80. It follows that the electric motor device 73 is no longer supplied.

AUTOMATIC WITHDRAWAL OF ARM 6

An impulse on input 84 of a memory device 85 controls the sending of a signal on input E2 of block 78 through OR gate 81.

The signal sent by the "End of Course" switch 82 is supplied to the resetting input 86 of memory 85 which returns the memory to its initial state and in that manner cuts the feeding of electric motor device 73.

PROPORTIONAL WITHDRAWAL

The winding action on the roller follower 14 causes the displacement of cell 87 of the displacement detector 70 and places it in position which produces a signal which, through amplifier 76 and block 78, causes the feeding of the motor device 73. The assembly 6,8, and 10 then moves away from the spool at low speed. If this speed is lower than the speed of increase of the spool size in the radial direction the roller makes a turning motion around axis Z-Z, which shifts cell 87 from the collector 70 so that it gives a higher level signal which corresponds to a higher speed of the electric motor device 73, and therefore of the withdrawal speed of the assembly housing. A stable state is reached when the withdrawal speed is equal to the speed of increase of the spool size in the radial direction.

In order to stop the withdrawal motion when lever 26 reaches the end of course contact 82, a control device 88 such as field effect transistor 88 is provided. The field effect transistor is connected in parallel with the amplifier 76 and thus cancels the exit signal of the amplifier applied at the input E3 of block 78 when "End of Course" contact 82 is actuated. The result is that the electric motor device 73 is no longer supplied; in that manner deterioration of device 73 is avoided.

MANUAL CLOSENESS

The pressure on a manual control button 89 sends a signal on the input E1 of block 78 through AND gate 90 and an OR gate 91.

When the closeness motion is ended, lever 26 actuates a "Closeness End of Course" contact 92 which cancels the signal given by the manual control button 89 through an OR gate 93 and an inverter 94, which causes the output signal delivered by AND gate 90 to be blocked.

AUTOMATIC CLOSENESS

An impulse on an input 95 of memory device 96 controls the sending of a signal to input E1 of block 78 through OR gate 91.

When this closeness motion is ended, the signal delivered by the "End of Course" switch 92 on the resetting input 97 of memory device 96 by the OR gate 93 resets this memory to its initial state and therefore stops the feeding of the electric motor device 73.

It is to be observed that because of the presence of OR gate 93 the withdrawal motion has priority over the closeness motion in order to avoid an accidental deterioration of the mechanism if the withdrawal and closeness information are given simultaneously.

In the two embodiments described above, the winding-machine comprises a spindle able to receive only one sleeve for the formation of a spool. The invention applies of course to winding-machines comprising two or more spindles mounted in a known way on a small turret, each spindle being able to be selectively placed in front of housing 8.

Moreover, each spindle can be made to receive several spools which are then simultaneously wound.

In that case, the reciprocating mechanism contained in the housing 8 must be able to activate as many traverse-guides as there are spools to be formed.

Regarding the first embodiment of FIGS. 1 to 5, it can be observed that the motor fluid can directly be oil under pressure furnished by a hydraulic pump. In this case, the air-oil exchangers 40 and 43 are of course not necessary. However, the control devices such as valves 54 and 62 remain of an electric type, according to the current technique in hydraulics.

Again in the embodiment of FIGS. 1 to 5, it can be observed that valves 20 and 41 can be placed in other places in the hydraulic circuit. In fact, it is possible for instance to mount them in parallel with the exchanger 40 and the corresponding input opening to jack 27. In this case the counterpressure offered on the side opposite to the piston rod of jack 27 is the atmospheric pressure. The jack diameter must then be dimensioned in order that the push of the atmospheric pressure is in opposition in all cases to the withdrawal efforts of the outfit housing parts 6,8, and 10 in comparison with the spindle 2 and the spool, due to spring 4*a*.

According to the preceeding detailed description of two embodiments of the invention, it can be observed that the invention provides a winding-machine which presents the following advantages.

The mechanism of the thread-guide 10 is moved away from the spindle receiving the spool being formed according to a continuous moving-away motion. This motion is imparted in a very precise manner to the changing speed on the spool radially thanks to the presence of an excitation element formed either by valve 20, or by the displacement detector 70 which are elements of continuous adjustment.

The distance between the thread-guide and the spool can be perfectly constant in order to avoid affecting the deposit of the thread on the spool.

The pressure of roller follower 14 on the spool in formation is as low as possible and can be regulated at will by varying the tightness of spring 21.

Thanks to the presence of the two small collars 24 and 25 which are engaged at the start of the winding, relative differences between the peripheral speeds of roller follower 14 and of sleeve F are avoided. In fact, when starting, the roller follower 14 is brought to suitable peripheral speed before coming in contact with the surface of the spool in formation.

The pressure of the roller follower on the spool can be very low, that is, in the region of one newton, which is comparatively very low compared to the forces which are used in the prior art and particularly in the U.S. Pat. No. 3,547,361. It follows that in the winding-machine according to the invention, the wound thread practically does not suffer any changes.

The roller follower 14 is mounted on the oscillating support 12 which forms a vertical mass which permits reduction of the amplitude of oscillations that the system formed by the support and this roller can take under the effect of external forces.

Finally, it can be observed that though the winding-machine is described in its application to the spooling of glass strands coming out of a bushing, it is obvious that it can be used as well in any other application concerned with the production of spools from a fragile textile product, particularly when sensitive to abrasion with high spooling speeds of 50 meters per second or more requiring an accurate spooling. Of course, the winding-machine can also be used in applications in which the working conditions are not as strict. Moreover, thanks to the arrangement shown in FIG. 4 of oscillating bearings of the oscillating support 12, the winding-machine can be used in all the cases where the working conditions are very dirty. It is then sufficient to use an appropriate solvent for the washing of the joints.

We claim:

1. Winding apparatus, particularly for winding strand or rovings formed of thermoplastic material such as glass drawn from a bushing, said apparatus comprising a fixed frame, a collet rotatably mounted on the frame for receiving the strand, means for rotating the collet, a strand traverse guide assembly including an arm mounted by a pivot on the frame, a traverse guide mechanism mounted on said arm, said arm and said guide mechanism being mounted for conjoint rocking movement about the axis of said pivot, so that the traverse guide mechanism is movable toward and away from the axis of rotation of the collet, and control means for effecting said rocking movement of the traverse guide mechanism in a direction away from the collet according to the radial growth of a spool being formed on the collet, said control means comprising a control loop, said control loop comprising a follower mounted on said arm for rocking motion with respect to said arm in response to radial growth of said spool, biasing means for urging said follower against the collet, variable speed drive means including a positive drive transmission tending when activated to move said arm in a direction to shift said follower away from the collet, thereby producing rocking withdrawal movement of the guide mechanism and the follower away from the axis of rotation of the collet against the action of said biasing means, and when not activated to substantially lock said guide mechanism and follower against rocking movement, and an excitation element operatively connected to said follower, said excitation element being continuously moveable in response to movements of said follower under the influence of radial growth of a spool being formed on the collet to activate said positive drive transmission to withdraw the traverse guide mechanism and the follower at a rate equal to the rate of radial growth of the spool.

2. Apparatus according to claim 1, further comprising counter balance means acting to neutralize the forces on said follower produced by said biasing means whereby said biasing means urges said follower against the spool surface with a relatively weak force.

3. Apparatus according to claim 2 wherein said follower comprises a roller element mounted for rotation with the spool surface during the course of spool development and collar means associated with said roller for holding said roller out of contact with the spool until a predetermined increase in spool diameter is achieved.

4. Winding-apparatus according to any one of the foregoing claims wherein said drive means for the arm is a hydraulic motor and said excitation element comprises a hydraulic valve, an outlet passageway connected to the outlet of said motor, said valve being moveable by said follower and providing a variable restriction in the passageway which is a function of spool growth.

5. Apparatus according to claim 4 wherein said motor is a hydraulic jack.

6. Apparatus according to any one of claims 1, 2 and 3 wherein said excitation device is an electrical control element providing an electrical control signal which is a function of spool growth, and wherein said drive means comprises a variable speed electric motor and circuit means electrically interconnecting said electrical control element and said variable speed motor for regulating motor speed in accordance with changes in said control signal.

7. Apparatus according to claim 1 further comprising control logic means in parallel relationship with said excitation element, said control logic means including manual and automatically actuated control devices for actuating said motor in the forward or reverse direction at a speed higher than the speed produced by said actuation element for selective movement of said arm towards and away from said collet.

8. Apparatus according to claim 4 wherein said valve comprises a housing having an axial bore and a spool within said bore, wherein said outlet passageway intersects said bore, and further wherein the spool is moveable by said follower to progressively restrict or open said passageway according to changes in the rate of radial growth of said spool as detected by said follower.

9. Winding apparatus according to claim 1 wherein said variable speed drive means comprises a hydraulically operated motor having an inlet connectible to a source of pressurized non-compressible operating fluid and an outlet through which hydraulic operating fluid is displaced, an unyieldable drive connection between the motor and the arm for moving said arm away from the axis of rotation of said collet under influence of said pressurized non-compressible operating fluid acting to drive said motor, said excitation element comprising means for variably controlling the discharge of operating fluid through the outlet of said hydraulically operated motor as a function of spool growth.

10. Winding apparatus according to claim 1 wherein said variable speed drive means comprises an electric motor, a geared drive connection interconneting said motor and said arm for driving said arm, and wherein said excitation element comprises means for variably controlling motor speed as a function of spool growth.

* * * * *